US005353718A

United States Patent [19]

Warchol et al.

[11] Patent Number: 5,353,718

[45] Date of Patent: Oct. 11, 1994

[54] REMEDIATION OF LOW LEVEL RADIOACTIVE MIXED WASTE IN A FLUIDIZED BED INCINERATOR

[75] Inventors: James J. Warchol; Daniel R. Rowley, both of Alliance; Thomas J. Flynn, North Canton, all of Ohio

[73] Assignee: The Babcock & Wilcox Company, New Orleans, La.

[21] Appl. No.: 970,726

[22] Filed: Nov. 3, 1992

[51] Int. Cl.[5] ..... F23B 7/00

[52] U.S. Cl. ..... 110/237; 110/216; 110/245; 588/900

[58] Field of Search ..... 110/245, 345, 346, 203, 110/204, 216, 237, 240, 255, 259, 185; 588/900

[56] References Cited

U.S. PATENT DOCUMENTS

| | | | |
|---|---|---|---|
| 1,137,780 | 5/1915 | Moore | 110/346 |
| 3,366,080 | 1/1968 | Albertson | 110/245 |
| 3,902,462 | 9/1975 | Bryers | 122/4 D |
| 4,180,004 | 12/1979 | Johnson | 110/346 |
| 4,522,131 | 6/1985 | Lebesgue | 110/229 |
| 4,615,302 | 10/1986 | Wynnyckyj et al. | 122/379 |
| 4,747,356 | 5/1988 | Beisswenger et al. | 110/343 |
| 4,915,039 | 4/1990 | Ringel | 110/346 |
| 4,991,521 | 2/1991 | Green et al. | 110/347 |
| 5,069,170 | 12/1991 | Gorzegno et al. | 122/4 D |
| 5,206,176 | 4/1993 | Beer et al. | 436/140 |

OTHER PUBLICATIONS

EPA Technology Profile, "Ogden Environmental Services" Nov. 1988.

Babcock & Wilcox Co., *Steam,* 40th Ed., pp. 16-1-1-6-19, 25-9-25-10, 1992, (admitted prior art).

B&W Preproposal, R&D 91-256, "Remediation of Mixed Waste Using an Enhanced CFB," U.S. E.P.A., Sep. 5, 1991.

B&W Proposal No. R&D 91-305, U.S. D.O.E. Dec. 13, 1991.

*Primary Examiner*—Henry A. Bennet
*Assistant Examiner*—William C. Doerrler
*Attorney, Agent, or Firm*—Daniel S. Kalka; Robert J. Edwards

[57] ABSTRACT

Mixed waste containing organic constituents and low level radioactive waste is remediated in a circulating fluidized bed combustor. Three separators are used to filter the flue gas and separate fine radioactive material from coarse non-radioactive material thereby concentrating the radioactive portion. A primary separator separates large material such as sand, lime, flyash or unburned fuel particles from the flue gas leaving the furnace of the combustor. The flue gas is then passed to a secondary separator for the collection of finer particles. In turn, the flue gas is passed to a tertiary separator for the collection of the finest particles of the flue gas containing low level radioactive waste. Solids entrained in the primary separator are recycled back into the bed of the combustor through an L-valve. Solids entrained at the secondary separator are also recycled back into the bed.

6 Claims, 1 Drawing Sheet

10
WATER IN
20
26
WATER IN
WATER OUT
36
30
40
44
34
AERATION
32
RECYCLED SOLIDS
24
16
22
50
59
58
56
54a
54
14
80
54b
SEAL AIR
12
5
7
9
WATER OUT
16
FRESH AIR

92
SCANIVALVE
91
PRESSURE INPUTS
98
TC JUNCTION
97
THE RIMOCOUPLE INPUTS
95
DAS
90
99

REMEDIATION OF LOW LEVEL RADIOACTIVE MIXED WASTE IN A FLUIDIZED BED INCINERATOR

BACKGROUND OF THE INVENTION

1. Field of the Invention

The present invention relates in general to the clean up of hazardous waste sites and in particular to a new and useful method and system for the remediation of low level radioactive mixed wastes in fluidized bed incinerators.

2. Description of the Related Art

Improved disposal and treatment methods are required to clean up hazardous waste sites that have resulted from years of uncontrolled dumping. The preferred approach for disposal of the wastes is through a process that not only destroys the hazardous organic portion of the waste, but also separates the radioactive portion from the nonradioactive portion.

SUMMARY OF THE INVENTION

The present invention comprises the use of a circulating fluidized bed combustor to remediate mixed waste containing organic constituents and low level radioactive waste. The process capitalizes on three principles. First, since the low level radioactive waste is present primarily in very fine material, the natural size classification process of a circulating fluidized bed can be used to separate fine radioactive material from coarse nonradioactive material, thus concentrating the radioactive portion. Second, since the attrition, e.g., size breakdown of soil particles, in a circulating fluidized bed is high, even more fine material is generated, further concentrating the radioactive portion of the waste stream. Third, the circulating fluidized bed can be operated with a gas residence time of 1–2 seconds at 1700°–1800° F. to destroy organic constituents in the waste such as dioxins, furans and PCBs.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figures 1, 2:
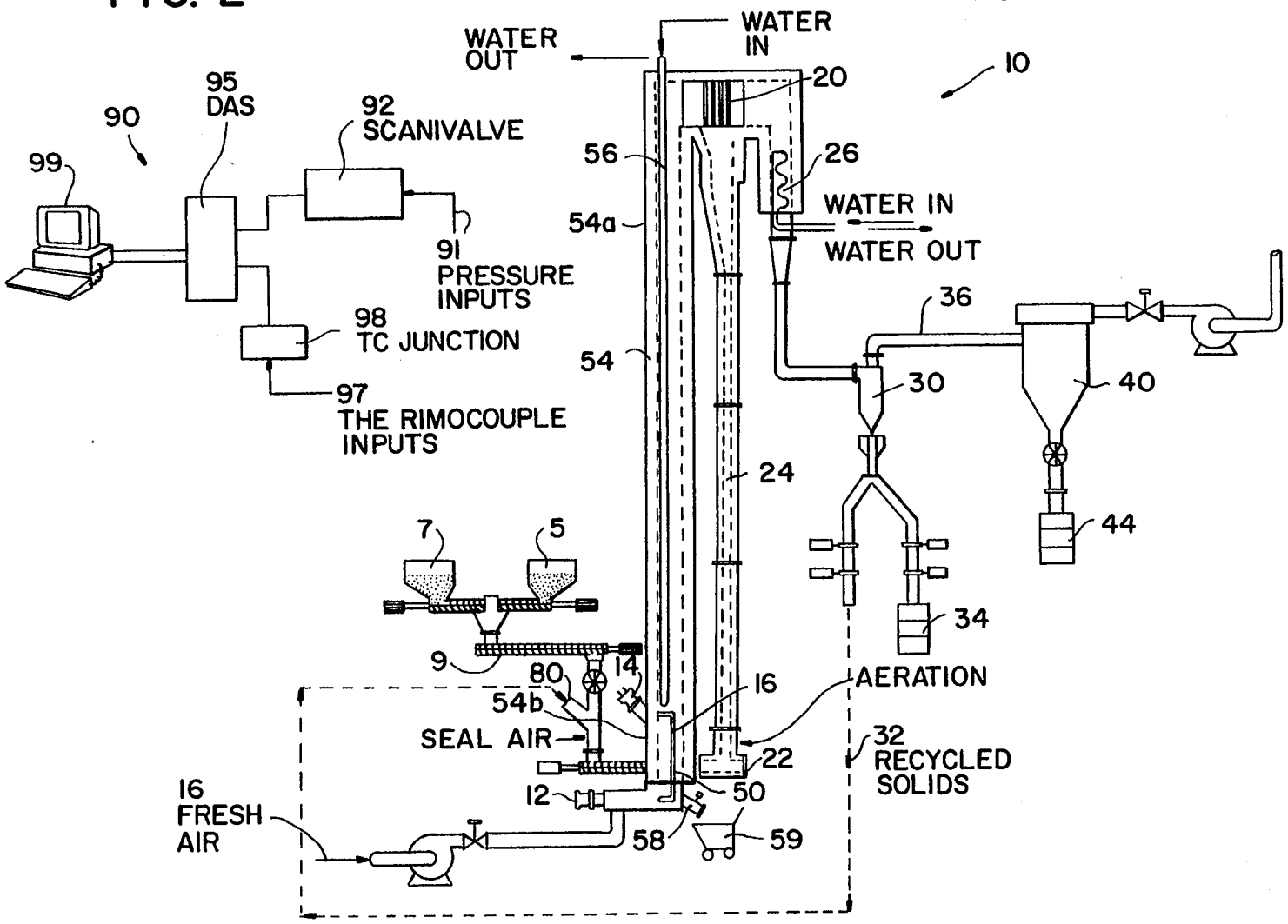
FIG. 1 is a side elevational view of a circulating fluidized bed combustor according the present invention.
FIG. 2 is a schematic drawing of a data acquisition system according to the present invention.

Referring to the present invention embodied in FIG. 1, a circulating fluidized bed combustor system, generally designated 10 comprises a furnace 54 containing a bed of solid particles 50. Furnace 54 may be either a refractory lined incinerator or membrane wall construction. The circulating fluidized bed combustor 10 has a fuel feeder 5 and sorbent feeder 7 positioned above the bed 50 for feeding the waste and sorbent into the bed 50. The combustor 10 can burn a variety of fuels such as waste coal, refuse derived fuel, tires, sludges, pulp, paper and wood waste. The combustor system 10 can also handle a relatively wide range of fuel feed sizes, thus reducing the need for preprocessing the waste fuels. Feed from the sorbent feeder 7 and the waste feeder 5 is provided to the bed 50 by means 9 for feed transport. A burner 14 is provided at the furnace 54 for starting up the unit on an auxiliary fuel such as natural gas, prior to the introduction of mixed wastes to the furnace. This provides heat to sustain the bed temperature. Air lines 16 provide air to the furnace 54. A wind box burner 12 preheats the air from the air lines 16.

Water is provided in furnace cooling tubes 56 arranged through the furnace 54 to allow adjustment of bed temperatures.

Upon burning of materials within the bed 50, combustion gases emanate from the bed 50 and pass through the furnace 54 to a primary separator 20. The primary separator 20 is located above the bed 50 and at the top of the furnace 54. The primary separator 20 is constructed of U-beams which are stainless steel channels installed in a labyrinth arrangement. The primary separator 20 removes large entrained bed material such as sand, lime, flyash or unburned fuel particles from the flue gas.

After passing through the primary separator 20, the combustion gas is then channeled through a convection pass cooling bundle 26 to a secondary cyclone separator 30. The secondary cyclone separator 30 separates fines from the flue gas.

After passing through the secondary cyclone separator 30 the flue gas is channeled through a second pass 36 to a tertiary separator 40 for tertiary separation. The tertiary separator 40 may consist of a high efficiency particulate filter, such as a Hepa filter. Any solids collected at the tertiary separator 40 are channelled to a collection container 44.

Solids separated from the gas by the secondary cyclone separator 30 are recycled back into the bed 50 by a transport system 32 which recycles the solids to a recycle point 80 located near the furnace 54. The recycle point 80 then channels the recycled solids from the secondary cyclone separator 30 back into the bed 50.

Larger size solid particles captured by the primary separator 20 are channeled through a stand pipe 24 which runs parallel with the furnace 54 to a L-valve 22. The L-valve 22 transports these recycled solids directly into the bed 50. Additionally, solids can be discharged into a secondary collection container 34 located at the secondary cyclone separator 30.

Solids can be drained from the circulating fluidized bed combustor 10 by a bed drain 58 which directly drains solids from the bed 50, from the secondary cyclone 30 at the collection container 34 or from the tertiary separator 40.

FIG. 2 shows a computerized data acquisition system 90 for the continuous monitoring of operating conditions of the circulating fluidized bed combustor 10. The data acquisition system 90 periodically scans system temperatures, air and gas flow rates, and system static and differential pressures.

The flue gas exiting the tertiary collector 40 is continuously monitored for $O_2$, CO unburned hydrocarbons and other gas constituents necessary to control the process. Thermocouple inputs 97 located at the circulating fluidized bed combustor 10 provide temperature information to the thermocouple junction 98 which is in turn received by the data acquisition system 95. All of this information received can be provided to an operator through the use of a CRT 99 linked to the data acquisition system 95.

Because there are special needs involved in the remediation of mixed waste the following can be incorporated into the present invention.

First, the circulating fluidized bed 10 can be fired with a clean auxiliary fuel such as gas or oil in the burner 14.

Second, the mixed waste can be fed above the bed so as to allow the greatest flexibility in accepting a wide range of wastes and sizes, thereby, minimizing the preprocessing of the waste for size reduction.

Third, in this system 10 the secondary cyclone separator 30 can be replaced by a variable efficiency cyclone separator. A variable efficiency cyclone will allow close control of the radioactive waste that is sent to the tertiary separator 40. As the concentration of radioactive material in the cyclone recycle stream 32 increases, the efficiency of the cyclone would be "spoiled" allowing more of the waste to pass to the tertiary separator 40. This would enable the operator to minimize the total amount of low level radioactive waste that would have to be sent to a nuclear waste storage vault. The balance of the waste, which would be "clean", would be removed from the bed drain 58 and would be sent back to an appropriate disposal site. The variable efficiency cyclones can operate in a range of size separation conducive to the isolation of radioactive waste.

Fourth, tertiary separation can be performed with a high efficiency particulate filter instead of a conventional baghouse or electrostatic precipitator. The high efficiency particulate filter can ensure that no radioactive waste escapes from the system in the flue gas stream.

Fifth, the system 10 can be portable by loading it onto a flat bed truck for set up at the site.

The circulating fluidized bed combustor system 10 has other advantages in addition to those mentioned above. The strong mixing in the furnace 54 and high solids circulation rate from the L-valve 22 and cyclone recycle lines 32 promote attrition of the mixed waste. This effect promotes the complete burnout of the combustible organic constituents of the waste as well as break up of the agglomerates containing trace amounts of radioactive material. The attrition of the agglomerates further enhances the effectiveness of the variable efficiency cyclone 30 to separate the trace radioactive material from "clean" solids.

With air staging it is possible to operate the lower furnace **54*b* at a temperature below the agglomerating temperature of the waste material, and an upper furnace 54*a* at a temperature (1700°-1800° F.) suitable for the complete destruction of organic constituents such as dioxins, PCBs, or furans. The height of the circulating fluidized bed 10** provides the necessary residence time for complete destruction of the organics. The degree of staging and the optimum gas time/temperature history can be determined for the present invention. The air staging also minimizes the production of nitrogen oxide emissions.

The process described above is based on a circulating fluidized bed incinerator operating at near atmospheric pressure, but could also be implemented in a pressurized fluidized bed with some variations. A pressurized fluidized bed is a more compact system since it operates at 10 to 15 times atmospheric pressure.

The circulating fluidized bed or the pressurized fluidized bed could be fired with oxygen enrichment to even further reduce the furnace and collection equipment size.

Ammonia injection could be used to further reduce nitrogen oxide emissions.

Limestone addition to the furnace or a scrubber downstream of the furnace could be used to control $SO_2$ emissions.

While a specific embodiment of the invention has been shown and described in detail to illustrate the application of the principles of the invention, it will be understood that the invention may be embodied otherwise without departing from such principles.

What is claimed is:

1. A method for concentrating a low level radioactive portion of a mixed waste and simultaneously combusting the organic portion in a circulating fluidized bed combustor, the method comprising the steps of:

feeding the mixed waste into the circulating fluidized bed combustor for combusting any hazardous organic portion into a flue gas;

channeling the flue gas through a primary separator for entraining and collecting large particles from the flue gas;

channeling the flue gas from the primary separator to a secondary separator which is a variable efficiency separator for entraining and collecting smaller particles from the flue gas;

channeling the flue gas from the secondary separator to a tertiary separator for collecting fine particles from the flue gas;

recycling the particles collected at the primary separator back into the circulating fluidized bed combustor for further combusting;

recycling the particles collected at the secondary separator back into the circulating fluidized bed combustor for further combusting; and removing the fine particles which include low level radioactive waste collected at the tertiary separator for disposal as low-level radioactive waste.

2. The method according to claim 1, wherein a clean fuel is used to fire the circulating fluidized bed combustor.

3. The method according to claim 1, wherein the feeding step includes the step of supplying the mixed waste to the circulating fluidized bed combustor at a location above the dense phase portion of the bed.

4. The method according to claim 1, wherein the tertiary separator includes a high efficiency particulate filter.

5. The method according to claim 1, wherein the circulating fluidized bed combustor is portable.

6. The method according to claim 1, wherein the primary separator is a cyclone separator.

* * * * *